US011398172B2

(12) United States Patent
Gao et al.

(10) Patent No.: US 11,398,172 B2
(45) Date of Patent: Jul. 26, 2022

(54) DISPLAY PANEL AND MANUFACTURING METHOD THEREOF, AND DISPLAY DEVICE

(71) Applicants: WUHAN TIANMA MICROELECTRONICS CO., LTD., Wuhan (CN); WUHAN TIANMA MICROELECTRONICS CO., LTD. SHANGHAI BRANCH, Shanghai (CN)

(72) Inventors: Zhuan Gao, Shanghai (CN); Xinzhao Liu, Shanghai (CN); Mengmeng Zhang, Shanghai (CN)

(73) Assignees: WUHAN TIANMA MICRO-ELECTRONICS CO., LTD., Wuhan (CN); WUHAN TIANMA MICROELECTRONICS CO., LTD. SHANGHAI BRANCH, Shanghai (CN)

( * ) Notice: Subject to any disclaimer, the term of this patent is extended or adjusted under 35 U.S.C. 154(b) by 0 days.

(21) Appl. No.: 17/215,494

(22) Filed: Mar. 29, 2021

(65) Prior Publication Data

US 2021/0256888 A1 Aug. 19, 2021

(30) Foreign Application Priority Data

Nov. 30, 2020 (CN) ..... 202011384448.X

(51) Int. Cl.
*G09G 3/00* (2006.01)

(52) U.S. Cl.
CPC ..... *G09G 3/006* (2013.01)

(58) Field of Classification Search
CPC ..... G09G 3/006; G09G 2300/0426; G09G 2330/027
USPC ..... 324/538, 537, 500
See application file for complete search history.

(56) References Cited

U.S. PATENT DOCUMENTS

| | | | | |
|---|---|---|---|---|
| 10,467,974 | B2 * | 11/2019 | Satoh | G09G 3/3648 |
| 11,222,561 | B2 * | 1/2022 | Wang | H01L 27/3225 |
| 2021/0272488 | A1 * | 9/2021 | Hwang | G09G 3/20 |

FOREIGN PATENT DOCUMENTS

| | | | |
|---|---|---|---|
| CN | 109377933 | A | 2/2019 |
| CN | 109407321 | A | 3/2019 |
| CN | 110910804 | A | 3/2020 |

* cited by examiner

*Primary Examiner* — Giovanni Astacio-Oquendo
(74) *Attorney, Agent, or Firm* — Tarolli, Sundheim, Covell & Tummino LLP

(57) ABSTRACT

A display panel is provided, including a test circuit, a display control switch and a selection circuit. In the test circuit, the test switch has a control terminal connected to the test control line, a first terminal connected to the test signal line, and a second terminal connected to the data line. In the display control circuit, the display switch has a control terminal connected to the display control line, a first terminal connected to the display signal line, and a second terminal connected to the data line. In the selection circuit, the selection switch has a control terminal connected to the selection control line, a first terminal connected to the selection signal terminal, and a second terminal connected to the display control line. The selection signal terminal provides a signal for turning off the display switch when the test switch and the selection switch are turned on.

20 Claims, 12 Drawing Sheets

DISPLAY PANEL AND MANUFACTURING METHOD THEREOF, AND DISPLAY DEVICE

CROSS-REFERENCE TO RELATED APPLICATIONS

The present application claims priority to Chinese Patent Application No. 202011384448.X, filed on Nov. 30, 2020, the content of which is incorporated herein by reference in its entirety.

TECHNICAL FIELD

The present disclosure relates to the field of display technologies, and particularly, to a display panel, a method for manufacturing the display panel, and a display device.

BACKGROUND

With continuous development of science and technology, more and more electronic devices having display functions are widely used in people's daily life and work, bringing great convenience and becoming an indispensable tool. A main component of the electronic device which realizes the display function is a display panel.

A visual test (VT) of the display panel is an important step in a production process of the display panel. The VT test refers to: after the display panel is manufactured, various signal lines including data lines and scan lines in the display panel are connected to corresponding test pads. Corresponding test signals are loaded to the respective test pads on the display panel via a test device so that the display panel displays images, thereby testing whether the structure including the signal lines in the display panel meets the quality requirements. The VT test may prevent defective products from entering the subsequent assembling step.

However, current VT test has a low accuracy and may not effectively test quality of the display panel.

SUMMARY

In view of the above, the present disclosure provides a display panel, a method for manufacturing the display panel, and a display device in order to improve accuracy of the VT test.

In a first aspect of the present disclosure, a display panel is provided. The display panel includes a display portion including a plurality of data lines; a test circuit including a test switch, a test signal line and a test control line, the test switch having a control terminal electrically connected to the test control line, a first terminal electrically connected to the test signal line, and a second terminal electrically connected to a respective one of the plurality of data lines; a display control circuit including a display switch, a display signal line and a display control line, the display switch having a control terminal electrically connected to the display control line, a first terminal electrically connected to the display signal line, and a second terminal electrically connected to a respective one of the plurality of data lines; and a selection circuit including a selection switch and a selection control line, the selection switch having a control terminal electrically connected to the selection control line, a first terminal electrically connected to a selection signal terminal, and a second terminal electrically connected to the display control line. The selection signal terminal is configured to provide a signal for turning off the display switch when the test switch and the selection switch are turned on.

In a second aspect of the present disclosure, a method for manufacturing a display panel is provided. The manufacturing method includes providing a substrate; forming a display portion including a plurality of data lines at a side of the substrate; and forming a test circuit, a display control circuit and a selection circuit at the same side of the substrate. The test circuit includes a test switch, a test signal line and a test control line, the test switch having a control terminal electrically connected to the test control line, a first terminal electrically connected to the test signal line, and a second terminal electrically connected to a respective one of the plurality of data lines; the display control circuit includes a display switch, a display signal line and a display control line, the display switch having a control terminal electrically connected to the display control line, a first terminal electrically connected to the display signal line, and a second terminal electrically connected to a respective one of the plurality of data lines; and the selection circuit includes a selection switch and a selection control line, the selection switch having a control terminal electrically connected to the selection control line, a first terminal electrically connected to a selection signal terminal, and a second terminal electrically connected to the display control line. The selection signal terminal is configured to provide a signal for turning off the display switch when the test switch and the selection switch are turned on; and testing the display panel.

In a third aspect of the present disclosure, a display device is provided. The display device includes a display panel, and the display panel includes: a display portion including a plurality of data lines; a test circuit including a test switch, a test signal line and a test control line, the test switch having a control terminal electrically connected to the test control line, a first terminal electrically connected to the test signal line, and a second terminal electrically connected to a respective one of the plurality of data lines; a display control circuit including a display switch, a display signal line and a display control line, the display switch having a control terminal electrically connected to the display control line, a first terminal electrically connected to the display signal line, and a second terminal electrically connected to a respective one of the plurality of data lines; and a selection circuit including a selection switch and a selection control line, the selection switch having a control terminal electrically connected to the selection control line, a first terminal electrically connected to a selection signal terminal, and a second terminal electrically connected to the display control line. The selection signal terminal is configured to provide a signal for turning off the display switch when the test switch and the selection switch are turned on.

In addition, in embodiments of the present disclosure, by configuring the selection circuit as a circuit structure including the selection switch, only a certain number of selection switches is required to be provided in the display panel, so that it is not necessary to provide a pad for providing signals to the display control line. At present, in order to ensure contact area between the pad and the subsequent chip to be bonded, area of the pad is usually provided large. Generally, the area of the pad is larger than the area of the selection switch. Therefore, compared with the solution of configuring a pad in the display panel to control the display switch to be turned off during the VT test, configuration of the present disclosure may ensure accuracy of the test result of the display panel, and may also avoid excessively increasing area of the non-display region in the display panel, thereby increasing the screen-to-body ratio of the display panel.

Moreover, if an abnormality occurs in a subsequent assembling process, these pads may be used to quickly test so as to check the abnormality.

Moreover, in a manufacturing process of the display panel, a display mother board having a larger area is formed first. The display mother board includes a plurality of display panels with a smaller area as described above. In an embodiment of the present disclosure, by reducing the area occupied by the test pad on the display panel, the space saved may be arranged with more display panels when the area of the display motherboard is constant. In particular, for the display panel used in wearable devices, its integration degree on the display mother board is relatively high. By adopting the configuration according to the embodiments of the present disclosure, a layout rate of the display mother board may be improved, which is beneficial to reduce production cost.

BRIEF DESCRIPTION OF DRAWINGS

In order to more clearly illustrate technical solutions of embodiments of the present disclosure, the accompanying drawings used in the embodiments are briefly described below. The drawings described below are merely a part of the embodiments of the present disclosure. Based on these drawings, those skilled in the art may obtain other drawings without creative effort.

DESCRIPTION OF EMBODIMENTS

In order to better understand technical solutions of the present disclosure, the embodiments of the present disclosure are described in detail with reference to the drawings.

It should be clear that the described embodiments are merely part of the embodiments of the present disclosure rather than all of the embodiments. All other embodiments obtained by those skilled in the art without creative effort shall fall into the protection scope of the present disclosure.

The terms used in the embodiments of the present disclosure are merely for the purpose of describing specific embodiments, rather than limiting the present disclosure. The terms "a", "an", "the" and "said" in a singular form in the embodiments of the present disclosure and the attached claims are also intended to include plural forms thereof, unless noted otherwise.

It should be understood that the term "and/or" used in the context of the present disclosure is to describe a correlation relation of related objects, indicating that there may be three relations, e. g., A and/or B may indicate only A, both A and B, and only B. In addition, the symbol "/" in the context generally indicates that the relation between the objects before and after the "/" is an "or" relation.

It should be understood that although the terms "first", "second", "third" and the like may be used in the present disclosure to describe data lines, these data lines should not be limited to these terms. These terms are used only to distinguish the data lines connected to sub-pixels having colors different from one another. For example, without departing from the scope of the embodiments of the present disclosure, a first data line may also be referred to as a second data line. Similarly, the second data line may also be referred to as the first data line.

Figure 1:
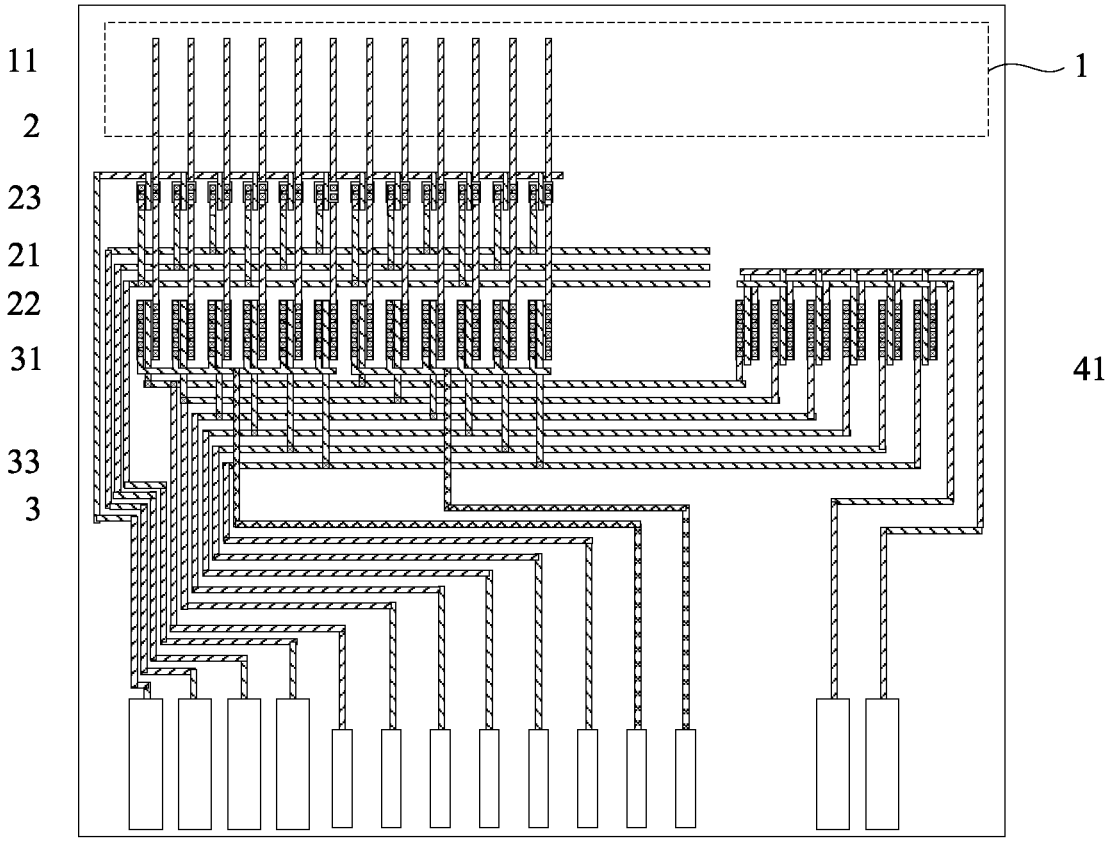
FIG. 1 is a wiring diagram of a display panel according to an embodiment of the present disclosure.
Figure 2:
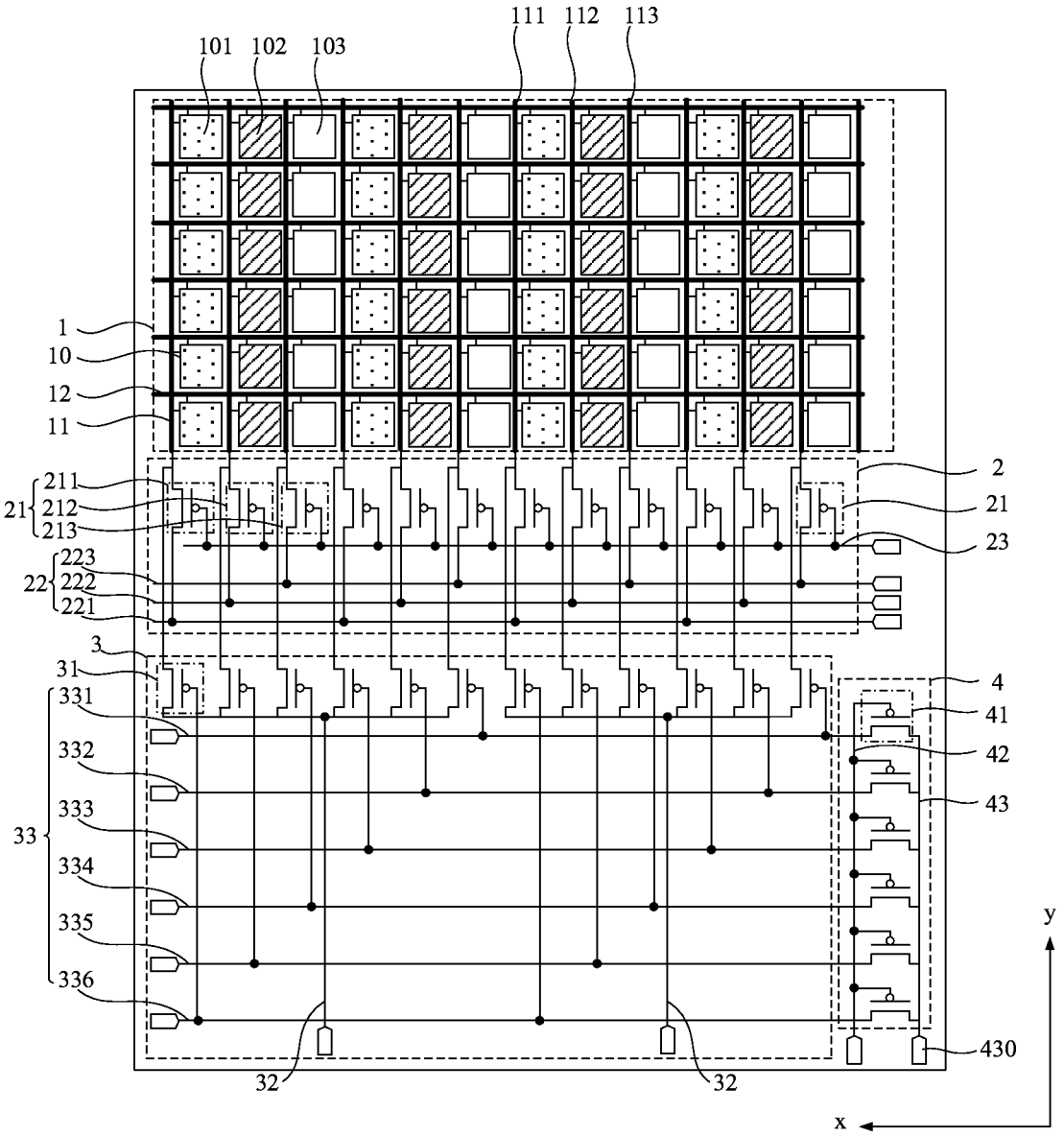
FIG. 2 is a schematic diagram showing an equivalent circuit of FIG. 1.

The present disclosure provides a display panel. As shown in FIGS. 1 and 2, FIG. 1 is a wiring diagram of a display panel according to an embodiment of the present disclosure, and FIG. 2 is a schematic diagram showing an equivalent circuit of FIG. 1. The display panel includes a display portion 1, a test circuit 2, a display control circuit 3 and a selection circuit 4.

The display portion 1 includes a plurality of sub-pixels (not shown in FIG. 1), and a plurality of data lines 11 and scan lines (not shown in FIG. 1) which are electrically connected to the sub-pixels. In an embodiment of the present disclosure, the display panel may be a liquid crystal display (LCD) panel, or may also be a self-luminous display panel using self-luminous technology, such as an organic light-emitting diode (OLED) display panel or a quantum light-emitting diode (QLED) display panel, etc. When the display panel is configured as a liquid crystal display panel, the above sub-pixels each include: a color filter having different light-emitting colors located on the color film substrate, a pixel electrode for controlling liquid crystal deflection between the color film substrate and an array substrate, and a common electrode. When the display panel is configured as an organic light-emitting display panel, the above sub-pixels each include: organic light-emitting devices capable of emitting light having different colors, and a pixel driving circuit for controlling the organic light-emitting devices to emit light.

The test circuit 2 is configured to test quality of the display panel after the display panel is manufactured. The test circuit 2 includes a test switch 21, a test signal line 22 and a test control line 23. A control terminal of the test switch 21 is electrically connected to the test control line 23, a first terminal of the test switch 21 is electrically connected to the test signal line 22, and a second terminal of the test switch 21 is electrically connected to the data line 11. The number of test signal line 22 may be set depending on number of colors of the sub-pixels 10. For example, the number of test signal line 22 may be set to be same as the number of light-emitting colors of the sub-pixel 10. For example, when the sub-pixel 10 includes a first-color sub-pixel 101 emitting light having a first color, a second-color sub-pixel 102 emitting light having a second color, and a third-color sub-pixel 103 emitting light having a third color, a first test signal line 221 that provides a test data signal to the first color sub-pixel 101, a second test signal line 222 that provides a test data signal to the second color sub-pixel 102, and a third test signal line 223 that provides a test data signal to the third color sub-pixel 103 may be configured in the test circuit 2. In an embodiment of the present disclosure, the first color may be red, the second color may be green, and the third color may be blue.

The display control circuit 3 is configured to control display of the sub-pixel 10 in the display portion 1 when the display panel displays images. The display control circuit 3 includes a display switch 31, a display signal line 32 and a display control line 33. A control terminal of the display switch 31 is electrically connected to the display control line 33, a first terminal of the display switch 31 is electrically connected to the display signal line 32, and a second terminal of the display switch 31 is electrically connected to the data line 11.

It should be noted that the above test circuit 2 may further include a scan test circuit for providing a testing signal to the scan line, and the display control circuit 3 may further include a scan control circuit for providing a signal to the scan line. The configuration and working principle of the scan test circuit and the scan control circuit are the same as those in the related art, and will not be elaborated here.

The selection circuit 4 includes a selection switch 41 and a selection control line 42. A control terminal of the selection switch 41 is electrically connected to the selection control line 42. In some embodiments of the present disclosure, the signal provided by the selection control line 42 enables the selection switch 41 and the test switch 21 to be turned on at the same time. A first terminal of the selection switch 41 is electrically connected to a selection signal terminal 430. For example, a first terminal of the selection switch 41 may be electrically connected to the selection signal terminal 430 by the selection signal line 43. A second terminal of the selection switch 41 is electrically connected to the display control line 33. The selection signal terminal 430 is configured to provide a signal for turning off the display switch 31 when the test switch 21 and the selection switch 41 are turned on.

Exemplarily, the above test switch 21, display switch 31, and selection switch 41 may be any structure realizing a switching function. For example, a thin film transistor (TFT) may be selected to form the test switch 21, the display switch 31, and the selection switch 41. When a thin film transistor is selected to form the test switch 21, the display switch 31 and the selection switch 41, the same patterning process may be adopted to form the test switch 21, the display switch 31, the selection switch 41, and the thin film transistor in the display portion 1 for controlling to light up the sub-pixel 10, thereby saving process time and improving production efficiency.

When the test switch 21, the display switch 31 and the selection switch 41 are each a thin film transistor, a gate electrode of the thin film transistor corresponds to the control terminal of each switch, a first electrode of the thin film transistor corresponds to the first terminal of the corresponding switch, and a second electrode of the thin film transistor corresponds to the second terminal of the corresponding switch. The first electrode of the thin film transistor is a source electrode and the second electrode thereof is a drain electrode. Alternatively, the first electrode of the thin film transistor is a drain electrode and the second electrode is a source electrode.

The above selection signal terminal 430 is configured to provide a signal to turn off the display switch 31 when the test switch 21 and the selection switch 41 are turned on. That is, when the display switch 31 is a P-type transistor, the selection signal terminal 430 is configured to provide a high-level signal when the test switch 21 and the selection switch 41 are turned on; alternatively, when the display switch 31 is an N-type transistor, the selection signal terminal 430 is configured to provide a low-level signal when the test switch 21 and the selection switch 41 are turned on.

After the display panel is manufactured, the present disclosure may adopt the above test circuit 2 to test quality of the display panel. In an embodiment of the present disclosure, upon testing the display panel, a signal for turning on the test switch 21 is provided to the test control line 23 so as to turn on the test switch 21. A test data signal is provided to the test signal line 22. The test data signal is transmitted to the corresponding data line 11 via the turned-on test switch 21, thereby lighting up the corresponding sub-pixel 10. Meanwhile, a signal for turning on the selection switch 41 is provided to the selection control line 42 so as to turn on the selection switch 41. A signal for turning off the display switch 31 is provided to the selection signal terminal 430. The signal for turning off the display switch 31 is transmitted to the display control line 33 via the selection switch 41, so that the display switch 31 is turned off under the control of the signal. In this process, it is possible to determine whether there are defects in the structure of the display panel including thin film transistors, scan lines, data lines, etc., based on lighting conditions of the sub-pixel 10 in the display portion 1.

After the test result indicates that the display panel is qualified, the test circuit 2 is stopped. A driving chip for driving the display panel to perform normal display operations may be bound to the display panel, which provides a signal for turning on the display switch 31 to the display control line 33 in order to turn on the display switch 31. The display data signal is provided to the display signal line 32 via the driving chip. The display data signal is transmitted to the corresponding data line 11 via the display switch 31, so that the corresponding sub-pixel 10 is lighted up with a set gray level.

It is appreciated that, when the test data signal is transmitted on the data line 11, the display switch 31 electrically connected to the data line 11 may be turned off by adopting the configuration according to the embodiments of the present disclosure. Therefore, during the VT test, the test data signal transmitted on the data line 11 may not leak through the display switch 31, so that accuracy of the test data signal transmitted on the data line 11 may be guaranteed, thereby ensuring accuracy of the test results of the display panel.

In addition, in an embodiment of the present disclosure, by configuring the selection circuit 4 as a circuit structure including the selection switch 41, it is only necessary to set a certain number of selection switches 41 in the display panel, so that there is no need to arrange the pad providing signals to the display control line 33 on the display panel.

Figure 3:
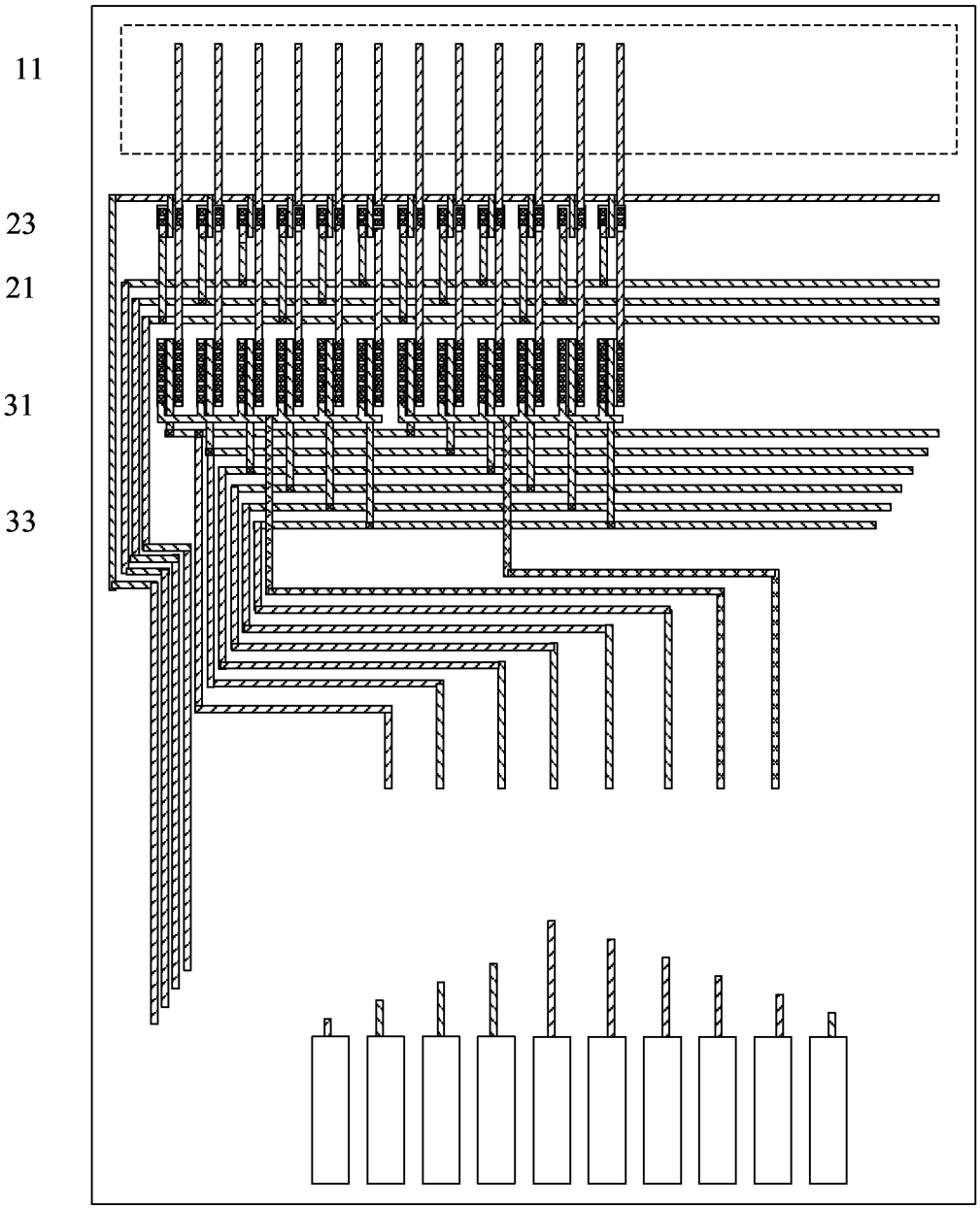
FIG. 3 (Prior Art)
FIG. 3 is a wiring diagram of a display panel in the related art.

FIG. 3 is a wiring diagram of a display panel in the related art. As shown in FIG. 3, the display panel includes a first test control pad 24', a second test control pad 26' and a test signal pad 25'. The first test control pad 24' is electrically connected to a control terminal of the test switch 21' via a first test control line 23'. The test signal pad 25' is electrically connected to a first terminal of the test switch 21' via the test signal line 22', and a second terminal of the test switch 21' is electrically connected to the data line 11'. The second test control pad 26' is electrically connected to the display control line 33'. The display control line 33' is electrically connected to a control terminal of the display switch 31'. During the VT test of the display panel, the first test control pad 24' provides a signal for turning on the test switch 21', and the second test control pad 26' provides a signal for turning off the display switch 31'.

At present, in order to ensure the contact area between the pad and the subsequent chip to be bound, the area of the first test control pad 24', the area of the second test control pad 26' and the area of the test signal pad 25' are usually set to be larger. Generally speaking, the area of each test pad described above may be larger than the area of the selection switch 41 according to the embodiments of the present disclosure. Since a lower step region of the display panel is also provided with various display pads, such as a display control pad 34' and a display signal pad 35' as shown in FIG. 3. Therefore, an installation space for the test pads left in the lower step region will be very limited. When the configuration shown in FIG. 3 is adopted, the test pad is usually placed at a side of the display pad away from the data lines. After the VT test is completed, the test pad is turned off to reduce the area of non-display region of the display panel. However, in this way, when entering an assembling process, if an abnormality occurs in the display panel, the checking process may be very troublesome.

Compared with the solution shown in FIG. 3 in which the second test control pad 26' is provided in the display panel to control the display switch 31' to be turned off during the VT test, using the configuration according to the embodiments of the present disclosure, the space occupied by the test pads on the display panel may be reduced while ensuring the accuracy of the test results of the display panel. When the test pad occupies a small space on the display panel, after the VT test is completed, the test pad that occupies a smaller space may be retained in the display panel without being removed by a cutting process. While simplifying the production process, it may also avoid excessively increasing the area of the non-display region in the display panel, which is beneficial to increasing the screen-to-body ratio of the display panel. In addition, if an abnormality occurs in a subsequent assembling process, these pads may be used to quickly test so as to check the abnormality.

Moreover, in a manufacturing process of the display panel, a display mother board having a larger area is formed first. The display mother board includes a plurality of display panels with a smaller area as described above. In an embodiment of the present disclosure, by reducing the area occupied by the test pad on the display panel, the space saved may be arranged with more display panels when the area of the display motherboard is constant. In particular, for the display panel used in wearable devices, its integration degree on the display mother board is relatively high. By adopting the configuration according to the embodiments of the present disclosure, a layout rate of the display mother board may be improved, which is beneficial to reduce production cost.

In an embodiment of the present disclosure, types of the test switch 21 and the selection switch 41 may be the same, that is, the turning-on signals of the test switch 21 and the selection switch 41 are the same, and the turn-off signals of the test switch 21 and the selection switch 41 are also the same. Such an arrangement may avoid introducing too many working signals in the display panel when the test switch 21 and the selection switch 41 is operated under the same signal and on the basis of ensuring that the test switch 21 and the selection switch 41 are turned on or turned off at the same time. For example, the test switch 21 and the selection switch 41 may each be a P-type transistor with high-level turn-off and low-level conduction, or may be each an N-type transistor with high-level conduction and low-level turn-off. As shown in FIG. 2, exemplarily, the test switch 21 and the selection switch 41 are each a P-type transistor. At this time, the selection signal may be a constant high-level signal VGH.

Exemplarily, as shown in FIG. 1, in the display panel according to an embodiment of the present disclosure, the test pad includes a test control pad 24 and a test signal pad 25. The test control pad 24 is electrically connected to the test control line 23. The test control pad 24 is configured to receive a test control signal. The test signal pad 25 is electrically connected to the test signal line 22. The test signal pad 25 is configured to receive a test data signal.

In an embodiment of the present disclosure, a number of the test signal pad 25 may be set according to the type of test signal required. For example, when the above sub-pixel 10 includes the first-color sub-pixel 101, the second-color sub-pixel 102 and the third-color sub-pixel 103, the test signal pad 25 may be configured to include a first test signal pad for providing test data signals to the first-color sub-pixel 101, a second test signal pad for providing test data signals to the second color sub-pixel 102, and a third test signal pad for providing test data signals to the third color sub-pixel 103.

Continue referring to FIGS. 1 and 2, the display panel according to an embodiment of the present disclosure further includes a selection control pad 44 and a selection signal pad 45. The selection control pad 44 is electrically connected to the selection control line 42. The selection control pad 44 is configured to receive a selection control signal. The selection signal pad 45 is connected to the above selection signal terminal 430. The selection signal pad 45 is configured to receive a selection signal. Exemplarily, when the test switch 21 and the selection switch 41 are P-type transistors as shown in FIG. 2, the selection signal may be configured as a constant high-level signal VGH. At this time, the existing pads in the display panel for providing a constant high-level signal VGH to the scan circuit may also be used as the selection signal pad 45, so that the number of pad in the display panel may be reduced, thereby reducing the display the area of the non-display region where the pad of the display panel is located. Similarly, when the test switch 21 and the selection switch 41 are each an N-type transistor, the existing pad in the display panel for providing a constant low-level signal VGL to the scan circuit may also be used as the selection signal pad 45.

When the VT test is performed on the display panel, the corresponding terminals of the test device that provides a test signal source may be connected to the test control pad 24, the test signal pad 25, the selection control pad 44 and the selection signal pad 45 on the display panel, respectively. For example, a probe method may be used to connect a plurality of testing probes connected to the test device to the test control pad 24, the test signal pad 25, the selection control pad 44 and the selection signal pad 45, respectively, so as to provide more test signals to the display panel. The test signal includes the test control signal, the test data signal, the selection control signal, and the like. After the VT test is completed, signal provision to the test control pad 24, the test signal pad 25, the selection control pad 44 and the selection signal pad 45 may be stopped.

Continue referring to FIG. 1, the display pads in the display panel according to an embodiment of the present disclosure include a display control pad 34 and a display signal pad 35. The display control pad 34 is electrically connected to the display control line 33. The display control pad 34 is configured to receive a display control signal. The display signal pad 35 is connected to the display signal line 32. The display signal pad 35 is configured to receive a display data signal.

In an embodiment of the present disclosure, the space occupied by the test pads including the test control pad 24 and the test signal pad 25 is relatively small, therefore, as shown in FIG. 1, after the VT test is completed, in an embodiment of the present disclosure, the test pads, the selection control pad 44 and the selection signal pad 45 that provide signals to the selection circuit 4 may be retained in the display panel without being removed. If an abnormality occurs in a subsequent module stage, these pads may be used to quickly test so as to check the abnormal problem.

After the VT test is completed, if the display panel meets quality requirements, the driving chip may be bonded to the display panel in an embodiment of the present disclosure. In an embodiment of the present disclosure, a pin that provides a display control signal in the driving chip may be connected to the above display control pad 34, and a pin that provides a display data signal in the driving chip may be connected to the display signal pad 35. When the display panel performs display function, various display signals are provided to the display portion by using the driving chip.

Based on the configuration of FIG. 1, if the test control pad 24, the test signal pad 25, the selection control pad 44 and the selection signal pad 45 are retained in the display panel, signals for turning off the test switch 21 and the selection switch 41 are provided to the above test control pad 24 and the selection control pad 44, respectively, when the display panel display images. Alternatively, the test control pad 24, the test signal pad 25, the selection control pad 44 and the selection signal pad 45 may be in a floating state in which no signal is received. At this time, the signal on the data line 11 is not controlled by the test circuit 2. The signal on the display control line 33 is not controlled by the selection circuit 4.

Figure 4:
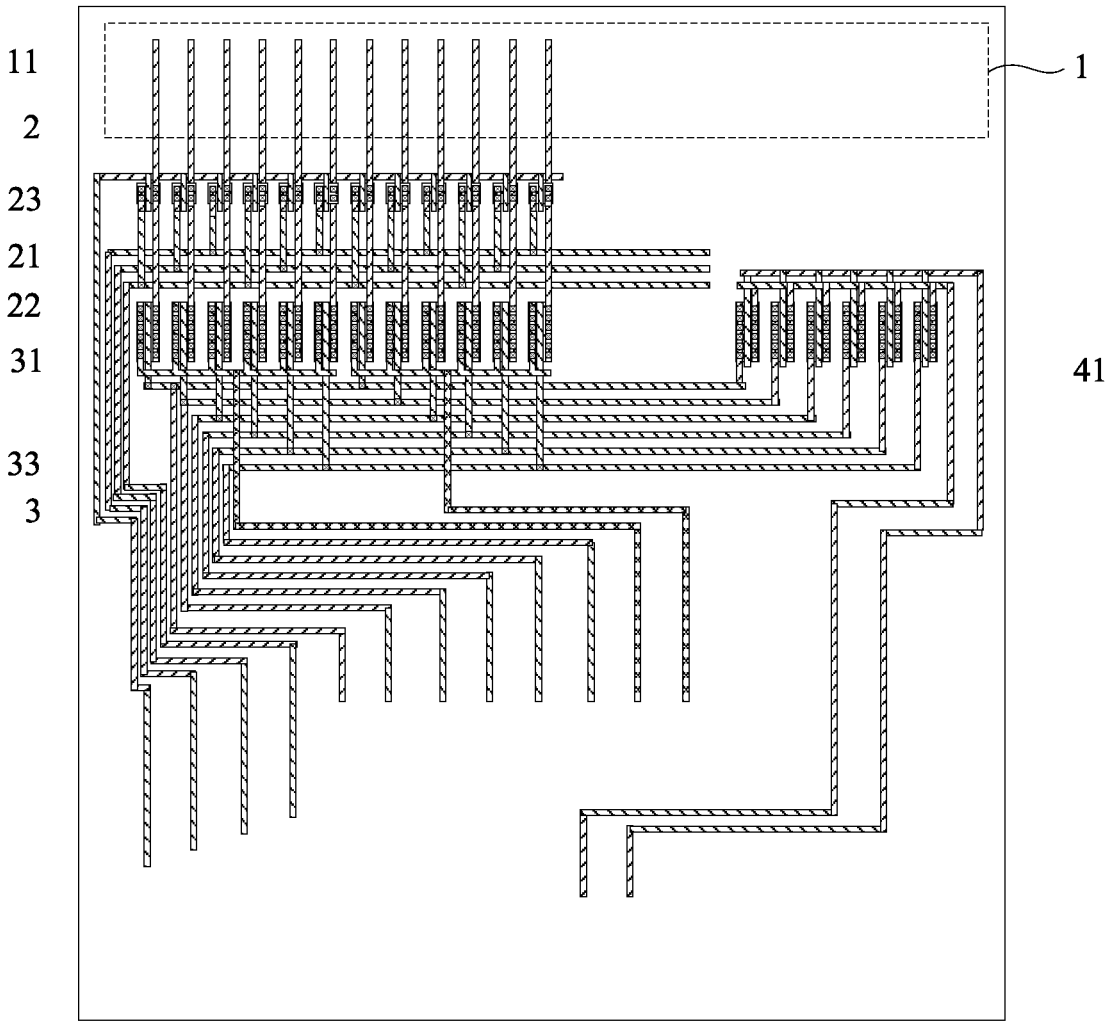
FIG. 4 is a wiring diagram of a display panel according to another embodiment of the present disclosure.

FIG. 4 is a wiring diagram of a display panel according to another embodiment of the present disclosure. Alternatively, as shown in FIG. 4, in an embodiment of the present disclosure, the test control pad 24, the test signal pad 25, the selection signal pad 45 and the selection control pad 44 may be provided at a side of the display control pad 34 away from the display portion 1. After the VT test is completed, if the display panel meets quality requirements, the test control pad 24, the test signal pad 25, the selection signal pad 45 and the selection control pad 44 may be removed. The driving chip is bound and connected to the display panel. In addition to ensuring normal display effect of the display panel, the area of the non-display region in the display panel may also be reduced.

It should be noted that winding manners of traces shown in FIG. 1, FIG. 3 and FIG. 4, as well as the area and shape of the pads, etc. are only exemplary. In an actual design process, it may be adjusted correspondingly depending on different performance requirements of the display panel and various components included therein.

Figure 5:
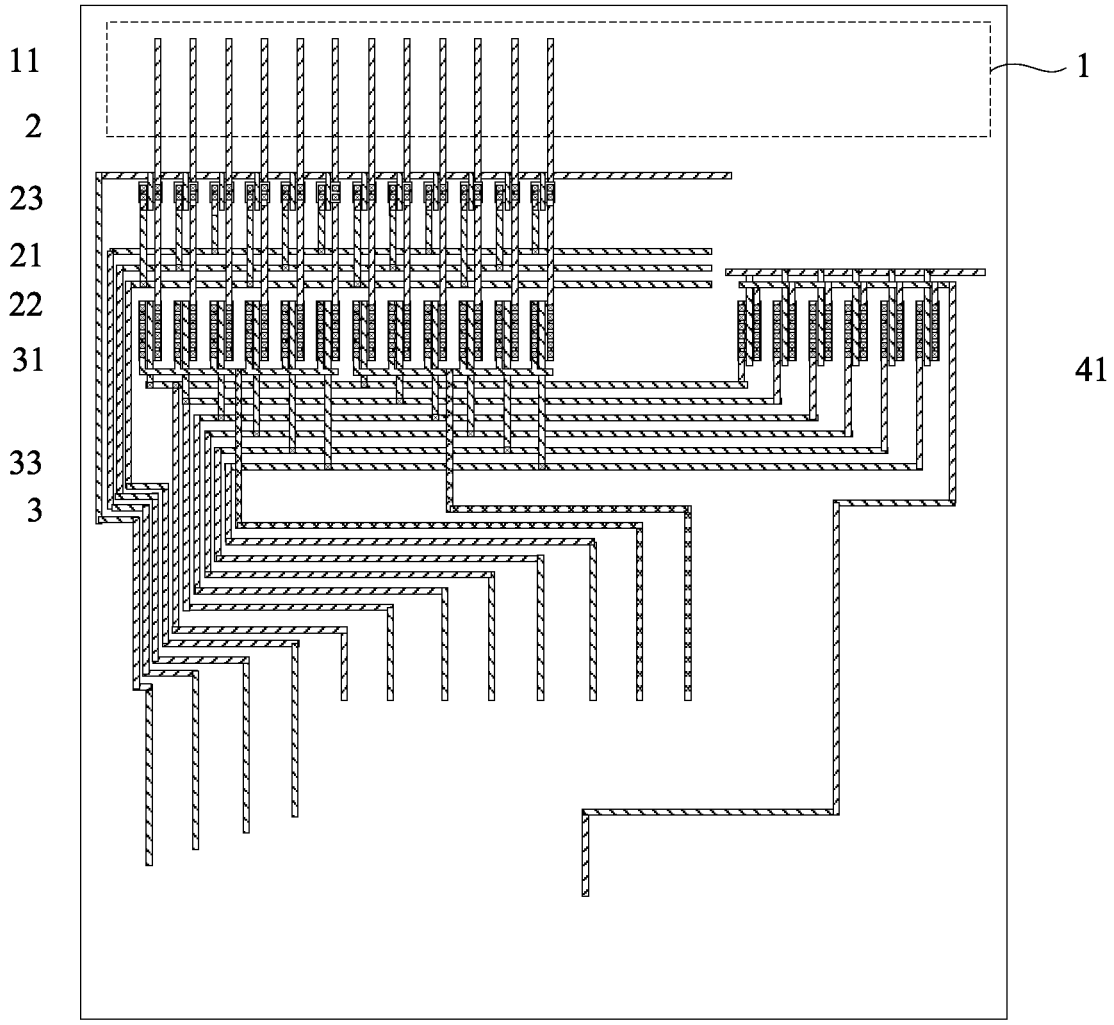
FIG. 5 is a wiring diagram of a display panel according to yet another embodiment of the present disclosure.
Figure 6:
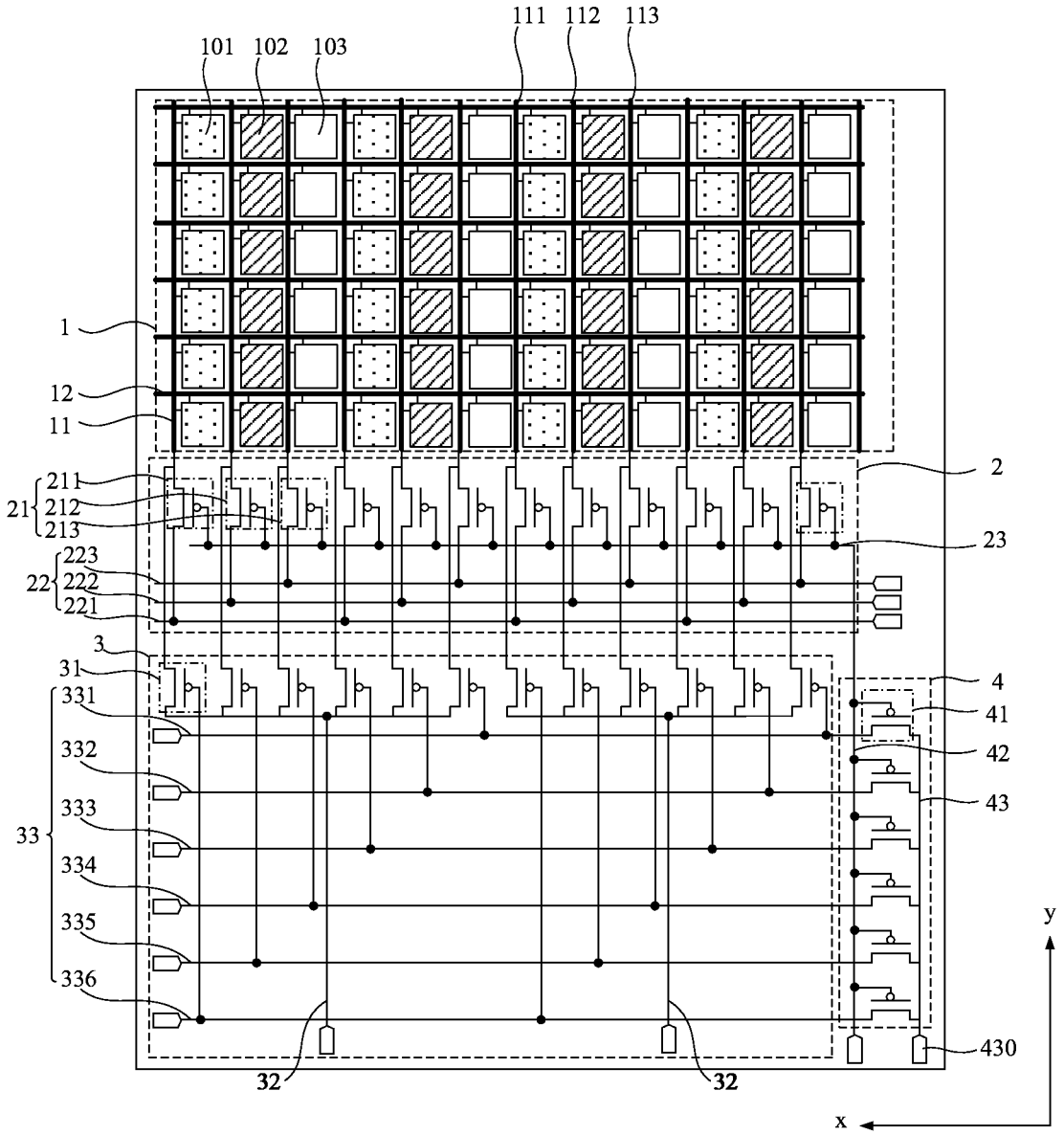
FIG. 6 is a schematic diagram showing an equivalent circuit of FIG. 5.

In an embodiment of the present disclosure, the above test control line 23 may also be used as the selection control line 42. FIG. 5 is a wiring diagram of a display panel according to yet another embodiment of the present disclosure; and FIG. 6 is a schematic diagram showing an equivalent circuit of FIG. 5. As shown in FIGS. 5 and 6, the test control line 23 is electrically connected to the selection control line 42. The test control line 23 and the selection control line 42 transmit the same signal. The control terminals of the test switch 21 and the selection switch 41 receive the same signal. This arrangement may integrate the test control pad 24 and the selection control pad 44 into one-piece, so that the number of pads provided on the display panel is further reduced, thereby further reducing the space occupied by the pads in the display panel.

As shown in FIG. 5, the test control pad 24, the test signal pad 25 and the selection signal pad 45 are provided at a side of the display control pad 34 away from the display portion 1. After the VT test is completed, the test control pad 24, the test signal pad 25 and the selection signal pad 45 may be removed to reduce area of the non-display region in the display panel. Alternatively, when the test control line 23 is also used as the selection control line 42, the test control pad 24, the test signal pad 25 and the selection signal pad 45 may also be configured as the manner shown in FIG. 1. In a final display panel, the test control pad 24, the test signal pad 25 and the selection signal pad 45 are retained.

Exemplarily, as shown in FIGS. 1 and 5, in an embodiment of the present disclosure, a plurality of data lines 11 is arranged along a first direction x, and extends along a second direction y intersecting with the first direction x. The selection circuit 4 at least partially overlaps the display control circuit 3 along the first direction x so as to avoid the circuit structure including the selection circuit 4 and the display control circuit 3 from occupying too much space of the display panel in the second direction y, so that it is beneficial to reduce the width of the non-display region of the display panel along the second direction y, thereby realizing narrow frame design of the display panel.

In an embodiment of the present disclosure, more than one display switches 31 is provided. A plurality of display switches 31 may be divided into a plurality of display switch groups. Each of the display switch groups includes m display switches. In the same display switch group, the first terminals of m display switches 31 are electrically connected to the same display signal line 32, in which m is an integer greater than or equal to 2. The second terminals of the m display switches 31 that are electrically connected to the same display signal line 32 are electrically connected to m different data lines 11. Moreover, the control terminals of m display switches 31 that are electrically connected to the same display signal line 32 are electrically connected to m different display control lines 33. In FIG. 1, FIG. 2, FIG. 5 and FIG. 6, as an example, there are two display switch groups, each of the display switch groups includes six display switches (i.e., m=6).

When the display panel performs display function, the scan control circuit time-division provides a scan signal in time division to the corresponding scan lines in the display portion 1. In the process of receiving the scan signals by each scan line, the driving chip sequentially supplies m display control lines 33 with a signal to turn on the display switch 31. Under the action of the signal transmitted by the corresponding display control line 33, the m display switches 31 that are electrically connected to the m data lines 11 are sequentially turned on. During a period of turning on any display switch 31, the display signal line 32 provides a display data signal to the corresponding data lines 11 so as to control the sub-pixels 10 that are electrically connected to the data line 11 to emit light, so that the display panel displays images.

In an embodiment of the present disclosure, by configuring the display control circuit 3 to include a plurality of display switch groups, it is possible to provide display data signals to m data lines 11 via one display signal line 32 in time division, so that each data line 11 may be avoided from directly connecting to the driving chip, thereby reducing the number of pins on the driving chip. Moreover, when the resolution of the display panel is high and the display portion 1 includes a large number of data lines 11, this arrangement may reduce the number of connection lines connecting the drive chip with the data lines 11, so that the area where the connection lines is located may be reduced, thereby further reducing the area of the non-display region of the display panel.

Exemplarily, in an embodiment of the present disclosure, the sub-pixels 10 may arrange in many different manners which will be described below.

In an embodiment of the present disclosure, the sub-pixels 10 having a same color may be arranged in a column along the second direction y, and the sub-pixels having different colors may be arranged alternately along the first direction x. In an embodiment of the present disclosure, as shown in FIG. 2, the first color sub-pixel 101, the second color sub-pixel 102 and the third color sub-pixel 103 may be alternately arranged along the first direction x.

Correspondingly, as shown in FIG. 2, in an embodiment of the present disclosure, the data line 11 may include a first data line 111, a second data line 112 and a third data line 113 that are arranged along the first direction x. The first data line 111, the second data line 112 and the third data line 113 each extend along the second direction y. The first data line 111 is electrically connected to a plurality of first color sub-pixels 101 arranged along the second direction y. The second data line 112 is electrically connected to a plurality of second color sub-pixels 102 arranged along the second direction y. The third data line 113 is electrically connected to a plurality of third color sub-pixels 103 arranged along the second direction y.

Based on this, in an embodiment of the present disclosure, $m \geq 3k$ may be set, in which k is an integer greater than or equal to 2. Moreover, among m different data lines 11 electrically connected to the same display signal line 32, at least k data lines 11 may be the first data line 111, at least other k data lines 11 may be the second data lines 112, and at least another k data lines 11 may be the third data line 113.

Taking the case of m=6 shown in FIGS. 2 and 6 as an example, among the six different data lines 11 electrically connected to the same display signal line 32, two data lines 11 may be the first data line 111, other two data lines 11 may be the second data line 112, and another two data lines 11 may be the third data line 113, that is, the above k is taken as 2.

When configuring the test circuit 2, referring to FIGS. 2 and 6, in an embodiment of the present disclosure, the test switch 21 may be configured to include a first test switch 211, a second test switch 212 and a third test switch 213; and the test signal line 22 may include a first test signal line 221, a second test signal line 222 and a third test signal line 223.

The control terminals of the first test switch 211, the second test switch 212 and the third test switch 213 may be electrically connected to the same test control line 23. A first terminal of the first test switch 211 is electrically connected to the first test signal line 221, and a second terminal of the first test switch 211 is electrically connected to the first data line 111. A first terminal of the second test switch 212 is electrically connected to the second test signal line 222, and a second terminal of the second test switch 212 is electrically connected to the second data line 112. A first terminal of the third test switch 213 is electrically connected to the third test signal line 223, and a second terminal of the third test switch 213 is electrically connected to the third data line 113.

When the VT test is performed on the display panel, pure color image testing in different colors may be performed on the display panel. For example, when the display panel is controlled to display a pure color image of a first color to test whether or not the related structure electrically connected to the first color sub-pixel 101 is in normal operation, in an embodiment of the present disclosure, a signal for turning on the first test switch 211, the second test switch 212 and the third test switch 213 may be provided to the test control line 23, and a first test signal may be provided to the first test signal line 221. The first test signal is transmitted to the first data line 111 via the first test switch 211 turned on, so that the first color sub-pixel 101 may be lighted up in cooperation with the scan test circuit. In this process, the second test signal line 222 and the third test signal line 223 may not be provided with the test signals. Similarly, when testing whether or not the related structure electrically connected to the second color sub-pixel is in normal operation, the second test signal may be provided to the second test signal line 222, but the test signals may not be provided to the first test signal line 221 and the third test signal line 223.

The foregoing description of the structure of the display panel is based on an example of arranging the sub-pixels 10 having the same color in a same column along the second direction y. In addition, in an embodiment of the present disclosure, the sub-pixels in the display portion 1 may also be arranged in other manners.

Figure 7:
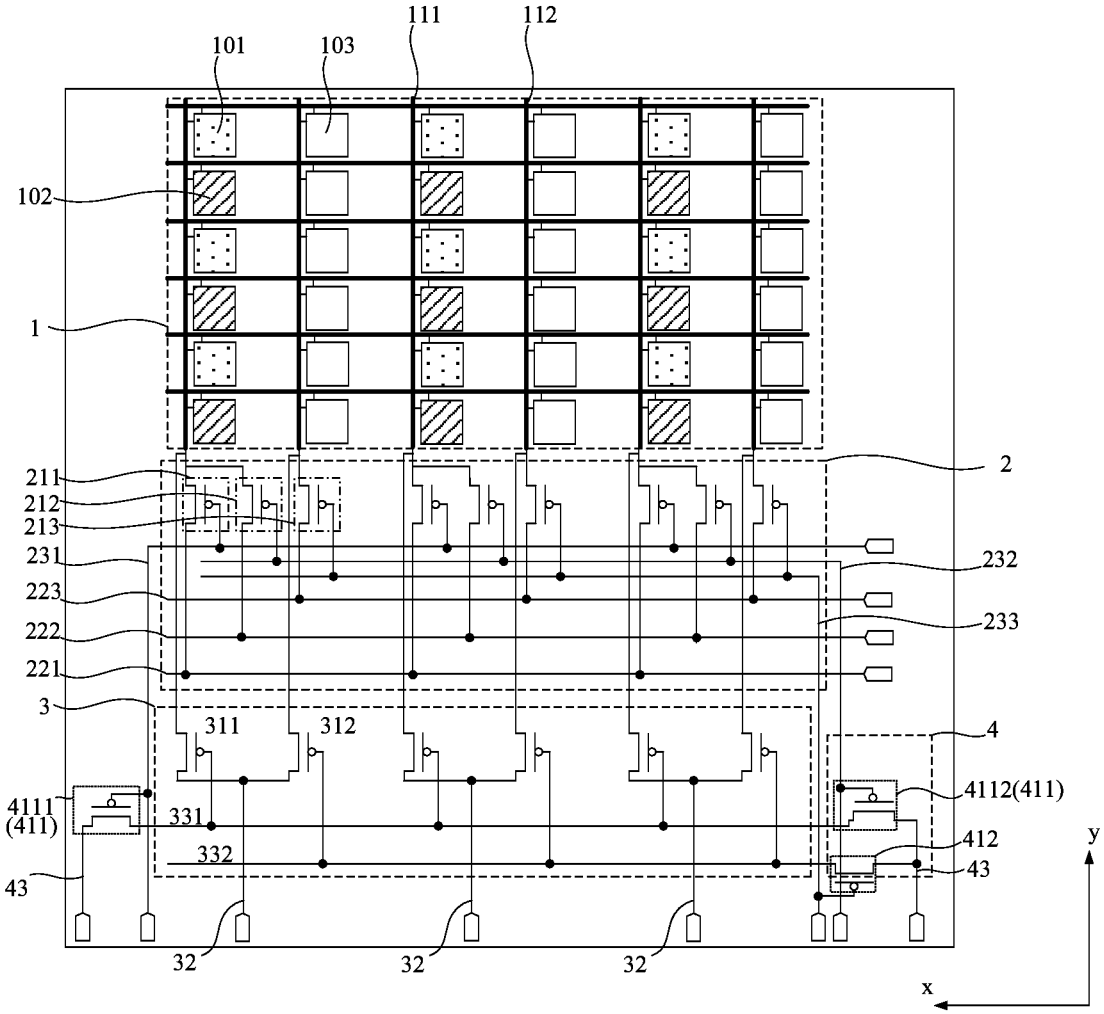
FIG. 7 is a schematic diagram showing an equivalent circuit of another display panel according to an embodiment of the present disclosure.

FIG. 7 is a schematic diagram showing an equivalent circuit of another display panel according to an embodiment of the present disclosure. As shown in FIG. 7, the first color sub-pixels 101 and the second color sub-pixels 102 may be alternately arranged along the second direction y as a same sub-pixel column, and the third-color sub-pixels 103 may be y arranged as another sub-pixel column. Correspondingly, when configuring the data line 11, as shown in FIG. 7, in an embodiment of the present disclosure, the data line 11 may be configured to include a first data line 111 and a second data line 112 that are arranged along the first direction x. The line 111 and the second data line 112 each extend in the second direction y. The first data line 111 is electrically connected to a plurality of first color sub-pixels 101 and second color sub-pixels 102 that are arranged alternately along the second direction y. The second data line 112 is electrically connected to a plurality of third color sub-pixels 103 arranged along the second direction y. A second data line 112 is provided between any two adjacent first data lines 111, and a first data line 111 is provided between any two adjacent second data lines 112. That is, the first data line 111 and the second data line 112 are alternately arranged along the first direction x.

The arrangement manner shown in FIG. 7 may be referred to as a sub-pixel rendered (SPR) arrangement. When the display panel performs display function, the first color sub-pixel 101 and the second color sub-pixel 102 that are electrically connected to the first data line 111 may form a pixel unit together with the adjacent third color sub-pixel 103 for display. By adopting the SPR arrangement and cooperating with corresponding pixel driving algorithm at the same time, the sensory resolution may be improved without increasing the process complexity while keeping the physical density of the sub-pixels unchanged.

Based on this, when configuring the display control circuit 3, in an embodiment of the present disclosure, $m \geq 2k$ may be set, in which k is an integer greater than or equal to 1. Moreover, at least k data lines are each the first data line 111, and at least another k data lines are each the second data line 112.

For example, as shown in FIG. 7, according to an embodiment of the present disclosure, m=2 may be set. As shown in FIG. 7, two display switches belonging to the same display switch group are referred to as 311 and 312, respectively. Two display control lines connected to the control terminals of the two display switches in one-to-one correspondence are marked as 331 and 332, respectively. Among two different data lines 11 electrically connected to the same display signal line 32, one of the two different data lines 11 is the first data line 111, and the other one of the two different data lines 11 is the second data line 112. That is, the above k is taken as 1 here.

When scan time of the scan line is constant, such arrangement configuration may ensure that the time period for receiving the data signal by the first data line 111 and the second data line 112 may not be too short, so that charging time of the sub-pixel 10 may be guaranteed, thereby ensuring the display effect of the sub-pixel 10.

When configuring the test circuit 2, referring to FIG. 7, in an embodiment of the present disclosure, the above test switch 21 may include a first test switch 211, a second test switch 212 and a third test switch 213. The test control line 23 may include a first test control line 231, a second test control line 232 and a third test control line 233. The test signal line 22 may include a first test signal line 221, a second test signal line 222 and a third test signal line 223.

A control terminal of the first test switch 211 is electrically connected to the first test control line 231, a first terminal of the first test switch 211 is electrically connected to the first test signal line 221, and a second terminal of the first test switch 211 is electrically connected to the first data line 111.

A control terminal of the second test switch 212 is electrically connected to the second test control line 232, a first terminal of the second test switch 212 is electrically connected to the second test signal line 222, and a second terminal of the second test switch 212 is electrically connected to the first data line 111.

A control terminal of the third test switch 213 is electrically connected to the third test control line 233, a first terminal of the third test switch 213 is electrically connected to the third test signal line 223, and a second terminal of the third test switch 213 is electrically connected to the second data line 112.

When the VT test is performed on the display panel, pure color image testing in different colors may be also performed on the display panel. For example, when the display panel is controlled to display a pure color image of a second color to test whether or not the related structure electrically connected to the second color sub-pixel 102 is in normal operation, in an embodiment of the present disclosure, a signal for turning on the second test switch 212 may be provided to the second test control line 232, and the signals for turning off the first test switch 211 and the third test switch 213 may be provided to the first test control line 231 and the third test control line 233, respectively. The second test signal is transmitted to the first data line 111 via the turned-on second test switch 212. Cooperating with the scan test control circuit, the second color sub-pixel 102 may be lighted up.

When configuring the selection circuit 4, in an embodiment of the present disclosure, the selection circuit 4 is provided with a first selection switch 411 electrically connected to the first display control line 331, and a second selection switch 412 electrically connected to the second display control line 332. The first selection switch 411 includes a first selection sub-switch 4111 and a second selection sub-switch 4112. A control terminal of the first selection sub-switch 4111 is electrically connected to the first test control line 231. A first terminal of the first selection sub-switch 4111 is electrically connected to the selection signal line 43, and a second terminal of the first selection sub-switch 4111 is electrically connected to the first display control line 331. A control terminal of the second selection sub-switch 4112 is electrically connected to the second test control line 232. A first terminal of the second selection sub-switch 4112 is electrically connected to the selection signal line 43, and a second terminal of the second selection sub-switch 4112 is electrically connected to the first display control line 331.

A control terminal of the second selection switch 412 is electrically connected to the third test control line 233. A first terminal of the second selection switch 412 is electrically connected to the selection signal line 43. A second terminal of the second selection switch 412 is electrically connected to the second display control line 332.

When the VT test is performed on the display panel, when the first test switch 211 or the second test switch 212 that are connected to the first data line 111 is turned on so as to provide the first test signal or the second test signal to the first data line 111, the first selection sub-switch 4111 or the second selection sub-switch 4112 in the first selection switch 411 is turned on accordingly so as to provide a signal for turning off the display switch 311 to the first display control line 331, so that leaking of the test data signal on the first data line 111 is avoided. When the third test switch 213 connected to the second data line 112 is turned on so as to provide the third test signal to the second data line 112, the second selection switch 412 is turned on so as to provide a signal for turning off the display switch 312 to the second display control line 332, so that leaking of the test data signal on the second data line 112 is avoided. Such a configuration ensures accuracy of the VT test of the display panel. Moreover, in an embodiment of the present disclosure, the control terminals of the first selection sub-switch 4111 and the second selection sub-switch 4112 are connected to the first test control line 231 and the second test control line 232, respectively, and the control terminal of the second selection switch 412 is connected to the third test control line 233, so that the number of pads in the display panel may be reduced.

Figure 8:
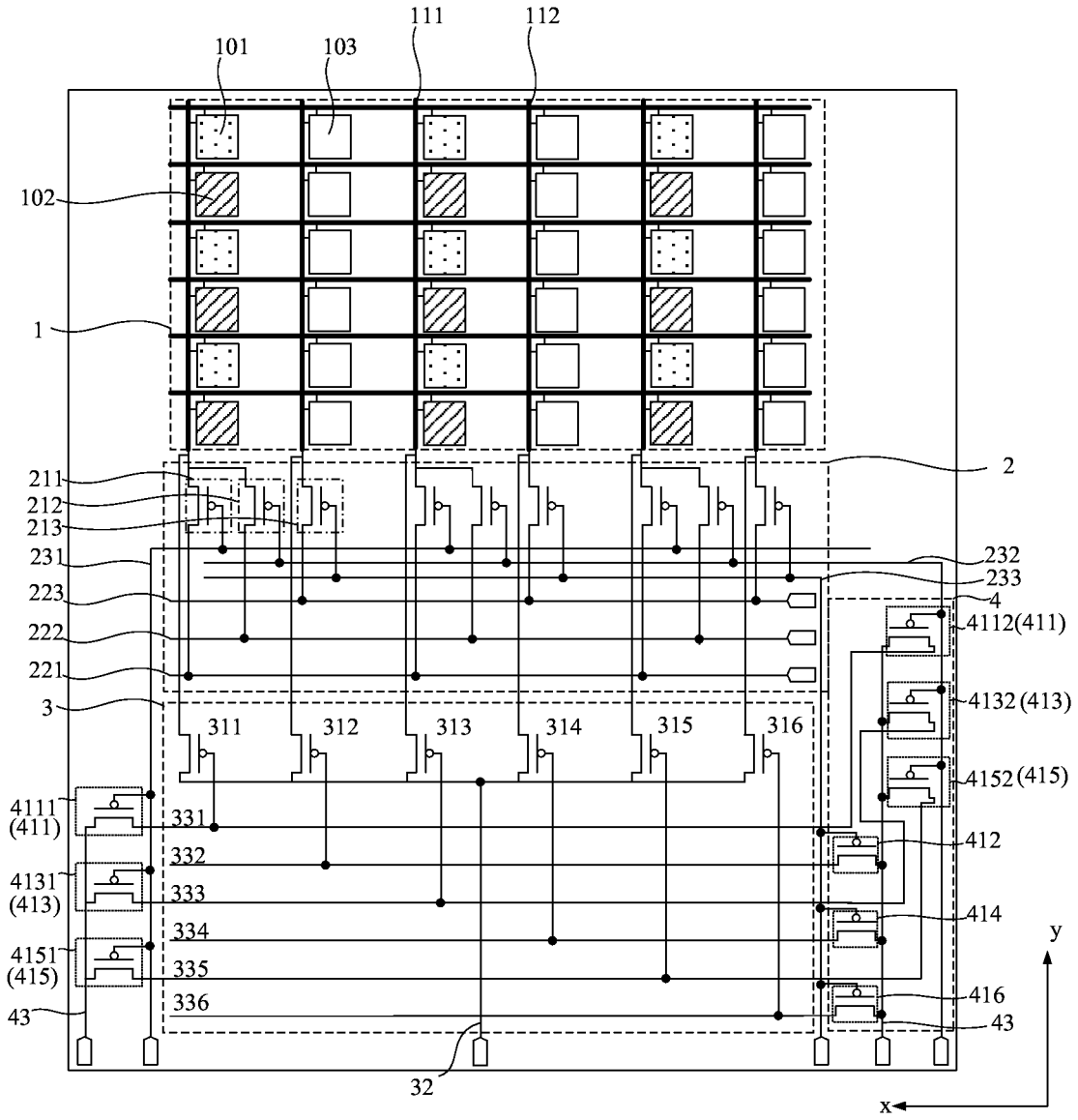
FIG. 8 is a schematic diagram showing an equivalent circuit of still another display panel according to another embodiment of the present disclosure.

FIG. 8 is a schematic diagram showing an equivalent circuit of another display panel according to another embodiment of the present disclosure. Alternatively, as shown in FIG. 8, m=6, and six display switches belonging to the same display switch group are referred to as 311, 312, 313, 314, 315 and 316, respectively. The six display control lines connected to the control terminals of the six display switches in one-to-one correspondence are referred to as 331, 332, 333, 334, 335 and 336, respectively. Among the six different data lines 11 that are electrically connected to the same display signal line 32, in an embodiment of the present disclosure, three of the six different data lines 11 may be the first data line 111, and the other three of the six different data lines 11 may be the second data line 112. That is, the above k is taken as 3 here.

When configuring the test circuit 2, in an embodiment of the present disclosure, similar to the configuration as shown in FIG. 7, the test switch 21 may include a first test switch 211, a second test switch 212 and a third test switch 213; the test control line 23 may include a first test control line 231, a second test control line 232 and a third test control line 233; and the test signal line 22 may include a first test signal line 221, a second test signal line 222 and a third test signal line 223.

A control terminal of the first test switch 211 is electrically connected to the first test control line 231, a first terminal of the first test switch 211 is electrically connected to the first test signal line 221, and a second terminal of the first test switch 211 is electrically connected to the first data line 111.

A control terminal of the second test switch 212 is electrically connected to the second test control line 232, a first terminal of the second test switch 212 is electrically connected to the second test signal line 222, and a second terminal of the second test switch 212 is electrically connected to the first data line 111.

A control terminal of the third test switch 213 is electrically connected to the third test control line 233, a first terminal of the third test switch 213 is electrically connected to the third test signal line 223, and a second terminal of the third test switch 213 is electrically connected to the second data line 112.

When configuring the selection circuit 4, in an embodiment of the present disclosure, a first selection switch 411 electrically connected to the first display control line 331, a third selection switch 413 electrically connected to the third display control line 333, and a fifth selection switch 415 electrically connected to the fifth display control line 335 are provided in the selection circuit 4. The first selection switch 411, the third selection switch 413 and the fifth selection switch 415 each include a first selection sub-switch and a second selection sub-switch. A control terminal of the first selection sub-switch is electrically connected to the first test control line 231. A control terminal of the second selection sub-switch is electrically connected to the second test control line 232. Moreover, a second selection switch 412 electrically connected to the second display control line 332, a fourth selection switch 414 electrically connected to the fourth display control line 334, and a sixth selection switch 416 electrically connected to the sixth display control line 336 are provided.

In the first selection switch 411, a control terminal of the first selection sub-switch 4111 is electrically connected to the first test control line 231, a first terminal of the first selection sub-switch 4111 is electrically connected to the selection signal line 43, and a second terminal of the first selection sub-switch 4111 is electrically connected to the first display control line 331; a control terminal of the second selection sub-switch 4112 is electrically connected to the second test control line 232, a first terminal of the second selection sub-switch 4112 is electrically connected to the selection signal line 43, and a second terminal of the second selection sub-switch 4112 is electrically connected to the first display control line 331.

In the third selection switch 413, a control terminal of the first selection sub-switch 4131 is electrically connected to the first test control line 231, a first terminal of the first selection sub-switch 4131 is electrically connected to the selection signal line 43, and a second terminal of the first selection sub-switch 4131 is electrically connected to the third display control line 333; a control terminal of the second selection sub-switch 4132 is electrically connected to the second test control line 232, a first terminal of the second selection sub-switch 4132 is electrically connected to the selection signal line 43, and a second terminal of the second selection sub-switch 4132 is electrically connected to the third display control line 333.

In the fifth selection switch 415, a control terminal of the first selection sub-switch 4151 is electrically connected to the first test control line 231, a first terminal of the first selection sub-switch 4151 is electrically connected to the selection signal line 43, and a second terminal of the first selection sub-switch 4151 is electrically connected to the fifth display control line 335; a control terminal of the second selection sub-switch 4152 is electrically connected to the second test control line 232, a first terminal of the second selection sub-switch 4152 is electrically connected to the selection signal line 43, and a second terminal of the second selection sub-switch 4152 is electrically connected to the fifth display control line 335.

The control terminals of the second selection switch 412, the fourth selection switch 414 and the sixth selection switch 416 are each electrically connected to the third test control line 233. The first terminals of the second selection switch 412, the fourth selection switch 414 and the sixth selection switch 416 are each electrically connected to the selection signal line 43. A second terminal of the second selection switch 412 is electrically connected to the second display control line 332. A second terminal of the fourth selection switch 414 is electrically connected to the fourth display control line 334. A second terminal of the sixth selection switch 416 is electrically connected to the sixth display control line 336.

When the VT test is performed on the display panel, there are four conditions as follows.

When the first test switch 211 or the second test switch 212 that is connected to the first one first data line 111 (counted from left to right in FIG. 8) is turned on so as to provide the first test signal or the second test signal to the first data line 111, the first selection sub-switch 4111 or the second selection sub-switch 4112 in the first selection switch 411 are turned on accordingly so as to provide the signal for turning off the display switch 311 to the first display control line 331, thereby avoiding leakage of the test data signal on the first one first data line 111.

When the first test switch 211 or the second test switch 212 that is connected to the third one first data line 111 (counted from left to right in FIG. 8) is turned on so as to provide the first test signal or the second test signal to the third first data line 111, the first selection sub-switch 4131 or the second selection sub-switch 4132 in the third selection switch 413 are turned on accordingly so as to provide the signal for turning off the display switch 313 to the third display control line 333, thereby avoiding leakage of the test data signal on the third one first data line 111.

When the first test switch 211 or the second test switch 212 that are connected to the fifth one first data line 111 (counted from left to right in FIG. 8) are turned on so as to provide the first test signal or the second test signal to the fifth first data line 111, the first selection sub-switch 4151 or the second selection sub-switch 4152 in the fifth selection switch 415 are turned on accordingly so as to provide the signal for turning off the display switch 315 to the fifth display control line 335, thereby avoiding leakage of the test data signal on the fifth one first data line 111.

When the third test switch 213 connected to the second data line 112 is turned on so as to provide the third test signal to the second data line 112, the second selection switch 412, the fourth selection switch 414 and the sixth selection switch 416 are turned on accordingly so as to provide signals for turning off the display switches 312, 314 and 316 to the second display control line 332, the fourth display control line 334 and the sixth display control line 336, respectively, thereby avoiding leakage of test data signal on the second data line 112.

When arranging the display panel, the test circuit 2, arrangement of the display portion 1 and the display control circuit 3 may be arranged in various manners. For example, as shown in FIG. 2, FIG. 6, FIG. 7 and FIG. 8, along an extending direction y of the data line 11, the test circuit 2 may be arranged between the display control circuit 3 and the display portion 1 in an embodiment of the present disclosure. Such an arrangement may reduce the distance between the test circuit 2 and the data line 11, reduce load of the connection line connecting the test circuit 2 with the data line 11, reduce attenuation of the test data signal transmitted to the data line 11, and ensure accuracy of the test data signal transmitted to the data line 11. Moreover, with this arrangement, the test data signal provided by the test circuit 2 is not required to pass through the display control circuit 3 during transmission to the display portion 1, so that it may prevent the test data signal from coupling with the wiring in the display control circuit 3, and thus it may further ensure accuracy of the test data signal.

Figure 9:
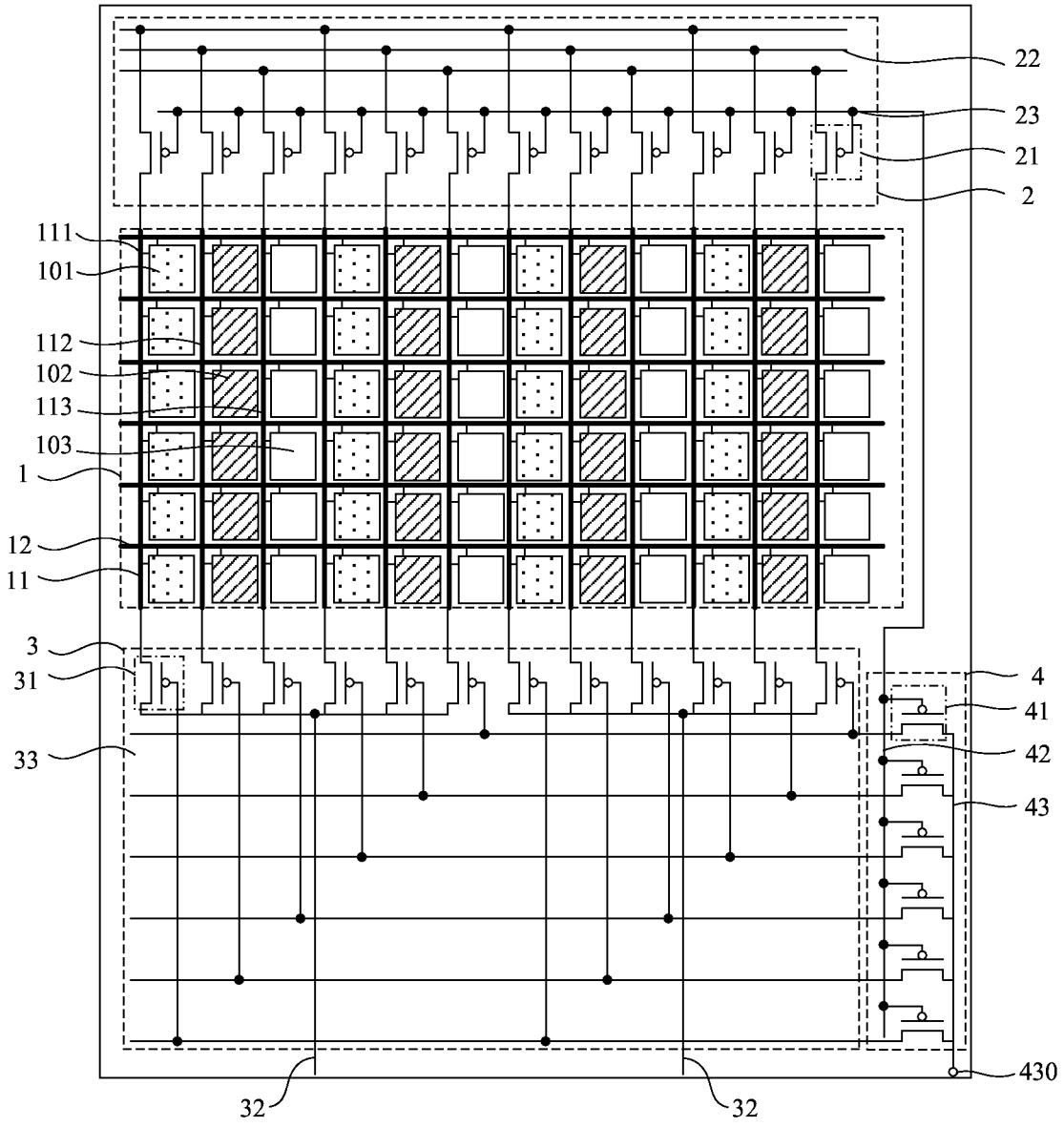
FIG. 9 is a schematic diagram showing an equivalent circuit of yet still another display panel according to another embodiment of the present disclosure.
Figure 10:
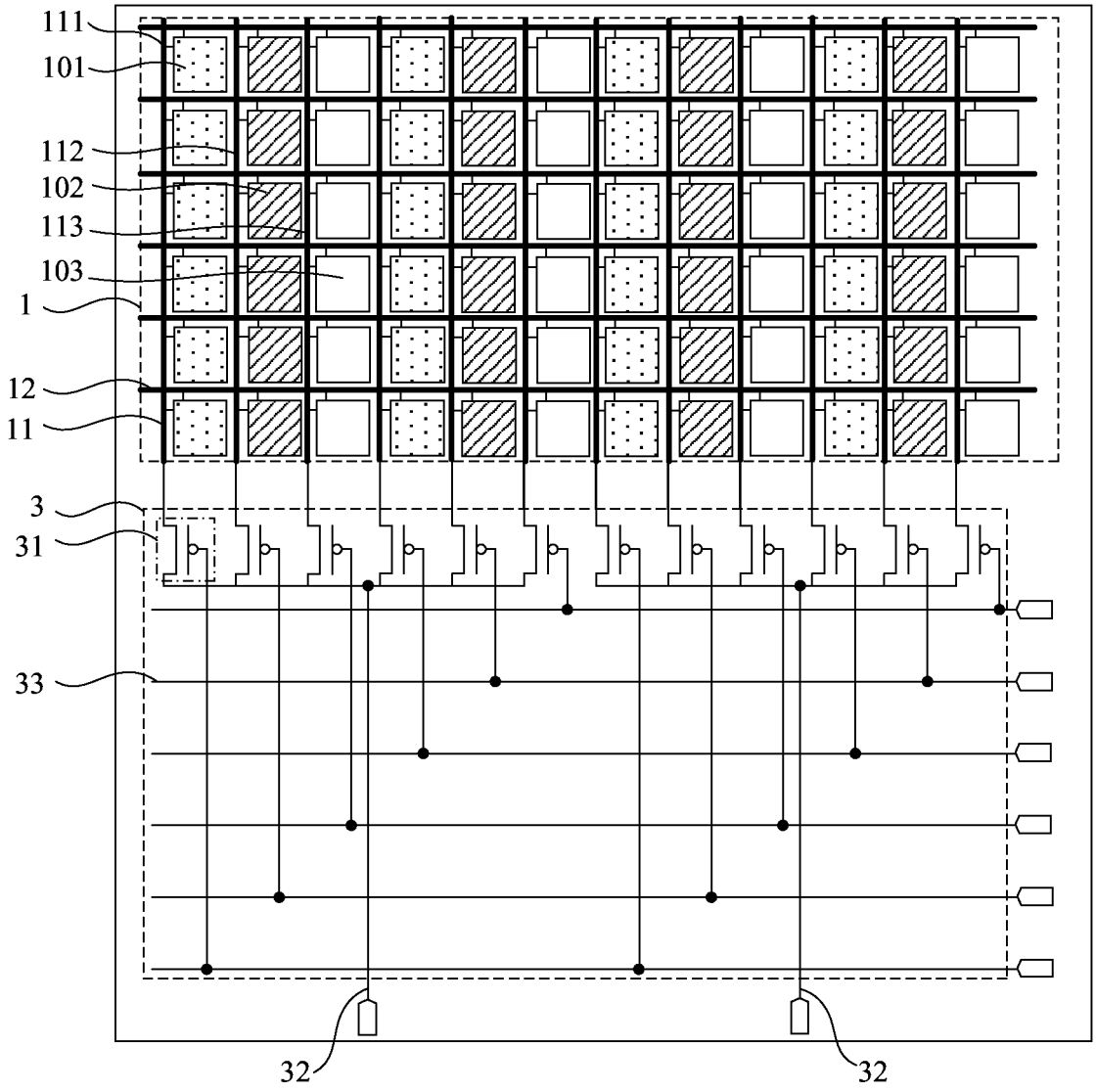
FIG. 10 is a schematic diagram showing a display panel according to another embodiment of the present disclosure.

FIG. 9 is a schematic diagram showing an equivalent circuit of still another display panel according to another embodiment of the present disclosure. Alternatively, as shown in FIG. 9, along an extending direction of the data line 11, the display portion 1 may also be arranged between the test circuit 2 and the display control circuit 3 in an embodiment of the present disclosure. Such an arrangement may also reduce the distance between the test circuit 2 and the data line 11, and prevent the test data signal provided by the test circuit 2 from passing through the display control circuit 3 during transmission to the display portion 1, thereby ensuring accuracy of the test signal. Moreover, with such an arrangement, after the testing is completed, the present disclosure may also adopt a cutting manner or other dividing manners to remove the test circuit 2 from the display portion 1, so that the final product does not retain the test circuit so as to form the structure shown in FIG. 10. FIG. 10 is a schematic diagram showing a display panel according to another embodiment of the present disclosure. By removing the test circuit 2 from the display portion 1, the area of the non-display region in the display panel may be reduced, which is beneficial to increasing the screen-to-body ratio of the display panel.

In an embodiment of the present disclosure, under the premise of not affecting the display control circuit 3, the selection circuit 4 may also be removed, so that the selection circuit 4 is not retained on the final display panel, thereby further increasing the screen-to-body ratio of the display panel.

Exemplarily, according to different application scenarios and display requirements, the shape of the display portion 1 may be designed into a variety of different shapes. For example, the display panel may be designed as circular or polygonal.

Figure 11:
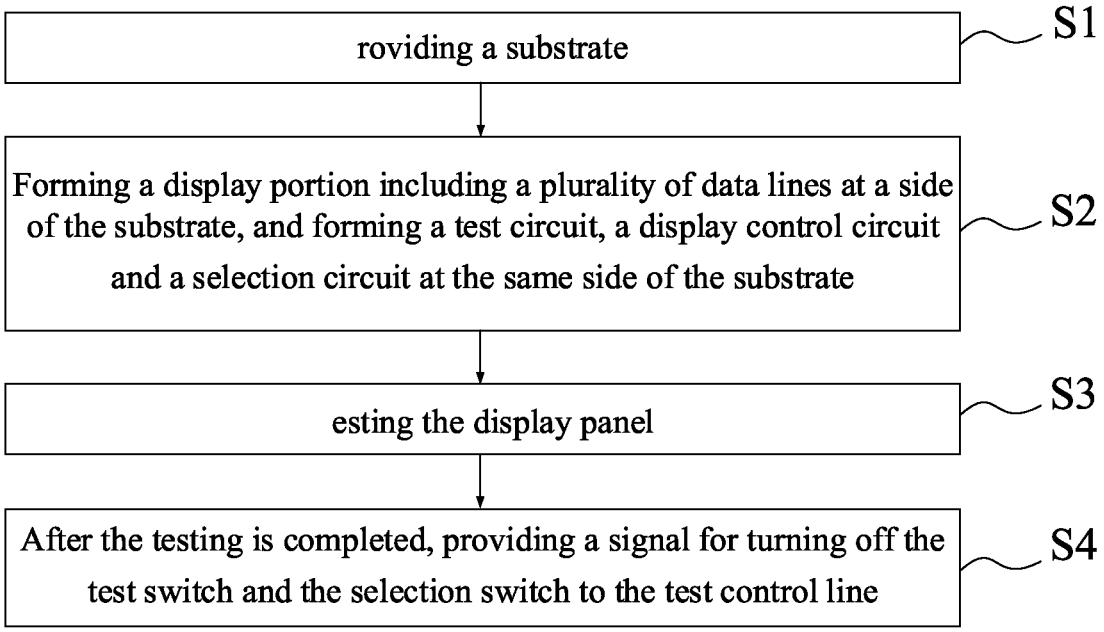
FIG. 11 is a flowchart showing a method for manufacturing a display panel according to an embodiment of the present disclosure.

The present disclosure also provides a method for manufacturing a display panel. FIG. 11 is a flowchart showing a method for manufacturing a display panel according to an embodiment of the present disclosure. As shown in FIG. 1, FIG. 2 and FIG. 11, the method includes following steps.

Step S1: providing a substrate 5.

Step S2: forming a display portion 1 including a plurality of data lines 11 at a side of the substrate 5; and forming a test circuit 2, a display control circuit 3 and a selection circuit 4 at the same side of the substrate 5.

The test circuit 2 includes a test switch 21, a test signal line 22 and a test control line 23. A control terminal of the test switch 21 is electrically connected to the test control line 23, a first terminal of the test switch 21 is electrically connected to the test signal line 22, and a second terminal of the test switch 21 is electrically connected to the data line 11.

The display control circuit 3 includes a display switch 31, a display signal line 32, and a display control line 33. A control terminal of the display switch 31 is electrically connected to the display control line 33, a first terminal of the display switch 31 is electrically connected to the display signal line 32, and a second terminal of the display switch 31 is electrically connected to the data line 11.

The selection circuit 4 includes a selection switch 41 and a selection control line 42. A control terminal of the selection switch 41 is electrically connected to the selection control line 42, a first terminal of the selection switch 41 is electrically connected to the selection signal terminal 430, and a second terminal of the selection switch 41 is electrically connected to the display control line 33. The selection signal terminal 430 is configured to provide a signal for turning off the display switch 31 when the test switch 21 and the selection switch 41 are turned on.

Step S3: testing the display panel. In an embodiment of the present disclosure, in the above method, testing the display panel includes:

providing a signal for turning on the test switch 21 and the selection switch 41 to the test control line 42, and at the same time, providing a signal for turning off the display switch 31 to the selection signal terminal 430.

In the method of manufacturing the display panel, the display switch 31 electrically connected to the data line 11 may be turned off when the VT test is performed on the display panel. Therefore, during the VT test, the test data signal transmitted on the data line 11 may not leak via the display switch 31, so that accuracy of the test data signal transmitted on the data line 11 is guaranteed, thereby ensuring accuracy of the test results of the display panel.

In addition, in embodiments of the present disclosure, by configuring the selection circuit 4 as a circuit structure including the selection switch 41, only a certain number of selection switches 41 is required to be provided in the display panel, so that it is not necessary to provide a pad for providing signals to the display control line 33. At present, in order to ensure contact area between the pad and the subsequent chip to be bonded, area of the pad is usually provided large. Generally, the area of the pad is larger than the area of the selection switch. Therefore, compared with the solution of configuring a pad in the display panel to control the display switch 31 to be turned off during the VT test, configuration of the present disclosure may ensure accuracy of the test result of the display panel, and may also avoid excessively increasing area of the non-display region in the display panel, thereby increasing the screen-to-body ratio of the display panel.

Exemplarily, as shown in FIG. 11, the above method further includes Step S4 as follows.

Step S4: after the testing is completed, providing a signal for turning off the test switch 21 and the selection switch 41 to the test control line 42, so as to prevent the signal on the display control line 33 from being affected when the display panel enters into the normal display stage, thereby ensuring normal display effect of the display panel.

In an embodiment of the present disclosure, as shown in FIG. 9, in an extending direction of the data line 11, the display portion 1 may be arranged between the test circuit 2 and the display control circuit 3. In this case, the above method further includes: after the testing is completed, removing the test circuit 2 from the display portion 1 to form the structure shown in FIG. 10. Exemplarily, the removing may be achieved by laser cutting.

Figure 12:
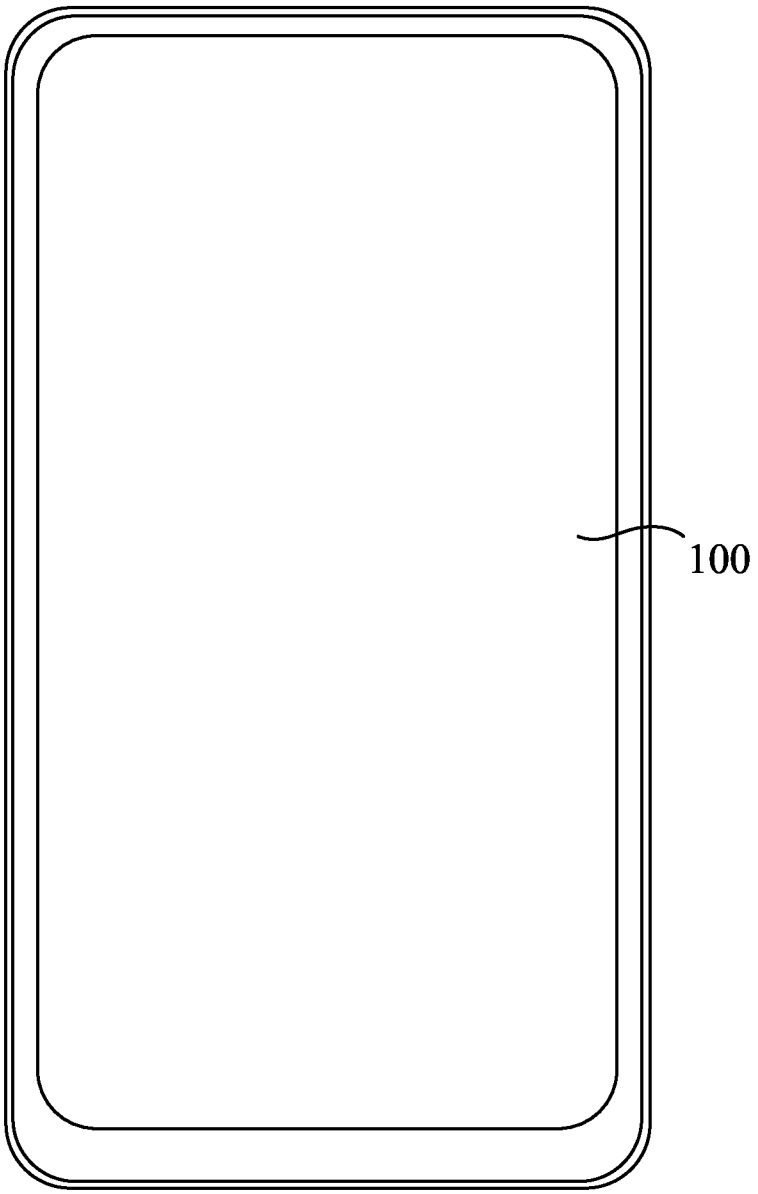
FIG. 12 is a schematic diagram showing a display device according to an embodiment of the present disclosure.

The present disclosure also provides a display device. FIG. 12 is a schematic diagram showing a display device according to an embodiment of the present disclosure. As shown in FIG. 12, the display device includes the above display panel 100. The specific structure of the display panel 100 has been described in detail in the above embodiments, and will not be elaborated here. It is appreciated that the display device shown in FIG. 12 is only exemplary, and the display device may be any electronic device having a display function such as wearable devices such as watches, mobile phones, tablet computers, laptop computers, electronic paper books or televisions.

The above are merely preferred embodiments of the present disclosure, which, as mentioned above, shall not be interpreted as limitations to the present disclosure. Within the principles of the present disclosure, any modification, equivalent substitution, improvement, etc., shall fall into the protection scope of the present disclosure.

What is claimed is:

1. A display panel, comprising:

a display portion comprising a plurality of data lines;

a test circuit comprising a test switch, a test signal line and a test control line, the test switch having a control terminal electrically connected to the test control line, a first terminal electrically connected to the test signal line, and a second terminal electrically connected to a respective one of the plurality of data lines;

a display control circuit comprising a display switch, a display signal line and a display control line, the display switch having a control terminal electrically connected to the display control line, a first terminal electrically connected to the display signal line, and a second terminal electrically connected to a respective one of the plurality of data lines; and a selection circuit comprising a selection switch and a selection control line, the selection switch having a control terminal electrically connected to the selection control line, a first terminal electrically connected to a selection signal terminal, and a second terminal electrically connected to the display control line, wherein the selection signal terminal is configured to provide a signal for turning off the display switch when the test switch and the selection switch are turned on.

2. The display panel according to claim 1, further comprising:

a test control pad electrically connected to the test control line;

a test signal pad electrically connected to the test signal line;

a display control pad electrically connected to the display control line; and a display signal pad electrically connected to the display signal line.

3. The display panel according to claim 1, wherein the test control line is also used as the selection control line.

4. The display panel according to claim 1, wherein the plurality of data lines is arranged along a first direction; and the selection circuit at least partially overlaps the display control circuit along the first direction.

5. The display panel according to claim 1, wherein the display control circuit comprises a plurality of display switches and a plurality of display control lines, the first terminals of m display switches among the plurality of display switches are electrically connected to a same display signal line, where m is an integer greater than or equal to 2;

the second terminals of the m display switches that are electrically connected to the same display signal line are electrically connected to m different data lines of the plurality of data lines, respectively; and the control terminals of the m display switches that are electrically connected to the same display signal line are electrically connected to m different display control lines of the plurality of display control lines, respectively.

6. The display panel according to claim 5, wherein the display portion further comprises a plurality of first color sub-pixels, a plurality of second color sub-pixels and a plurality of third color sub-pixels, and a color of each of the plurality of first color sub-pixels, a color of each of the plurality of second color sub-pixels and a color of each of the plurality of third color sub-pixels are different from one another;

the plurality of data lines comprises first data lines, second data lines and third data lines that are arranged along a first direction, each of the first data line, the second data line and the third data line extends along a second direction intersecting with the first direction;

each of the first data lines is electrically connected to more than one of the plurality of first color sub-pixels arranged along the second direction;

each of the second data lines is electrically connected to more than one of the plurality of second color sub-pixels arranged along the second direction;

each of the third data lines is electrically connected to more than one of the plurality of third color sub-pixels arranged along the second direction; and the more than one first color sub-pixels, the more than one second color sub-pixels and the more than one third color sub-pixels are alternately arranged along the first direction.

7. The display panel according to claim 6, wherein $m \geq 3k$, where k is an integer greater than or equal to 2; and among the m different data lines that are electrically connected to the same display signal line, at least k data lines of the m different data lines are first data lines, at least another k data lines of the m different data lines are second data lines, and at least another k data lines of the m different data lines are third data lines.

8. The display panel according to claim 6, wherein the test circuit comprises a plurality of test switches and a plurality of test signal lines, the plurality of test switches comprises a first test switch, a second test switch, and a third test switch, and the plurality of test signal lines comprises a first test signal line, a second test signal line, and a third test signal line;

the control terminal of the first test switch, the control terminal of the second test switch and the control terminal of the third test switch are electrically connected to the same test control line;

the first terminal of the first test switch is electrically connected to the first test signal line, and the second terminal of the first test switch is electrically connected to the first data line;

the first terminal of the second test switch is electrically connected to the second test signal line, and the second terminal of the second test switch is electrically connected to the second data line; and the first terminal of the third test switch is electrically connected to the third test signal line, and the second terminal of the third test switch is electrically connected to the third data line.

9. The display panel according to claim 5, wherein the display portion further comprises a plurality of first color sub-pixels, a plurality of second color sub-pixels and a plurality of third color sub-pixels, and a color of each of the plurality of first color sub-pixels, a color of each of the plurality of second color sub-pixels and a color of each of the plurality of third color sub-pixels are different from one another;

the plurality of data lines comprises first data lines and second data lines that are arranged along a first direction, each of the first data lines and the second data lines extends along a second direction intersecting with the first direction;

each of the first data lines is electrically connected to more than one of the plurality of first color sub-pixels and more than one of the plurality of second color sub-pixels that are alternately arranged along the second direction;

each of the second data lines is electrically connected to more than one of the plurality of third color sub-pixels arranged along the second direction; and one of the second data lines is arranged between any two adjacent first data lines, and one of the first data lines is arranged between any two adjacent second data lines.

10. The display panel according to claim 9, wherein $m \geq 2k$, where k is an integer greater than or equal to 1; and among the m different data lines that are electrically connected to the same display signal line, at least k data lines of the m different data lines are first data lines, and at least another k data lines of the m different data lines are second data lines.

11. The display panel according to claim 9, wherein the test circuit comprises a plurality of test switches, a plurality of test control lines, and a plurality of test signal lines, the plurality of test switches comprises a first test switch, a second test switch, and a third test switch;

the plurality of test control lines comprises a first test control line, a second test control line and a third test control line;

the plurality of test signal lines comprises a first test signal line, a second test signal line and a third test signal line;

the first test switch has a control terminal electrically connected to the first test control line, a first terminal electrically connected to the first test signal line, and a second terminal electrically connected to the first data line;

the second test switch a control terminal electrically connected to the second test control line, a first terminal electrically connected to the second test signal line, and a second terminal electrically connected to a respective one of the first data lines; and the third test switch a control terminal electrically connected to a third test control line, a first terminal electrically connected to the third test signal line, and a second terminal electrically connected to a respective one of the second data lines.

12. The display panel according to claim 1, wherein the test circuit is located between the display control circuit and the display portion along an extending direction of the plurality of data lines.

13. The display panel according to claim 1, wherein the display portion is located between the test circuit and the display control circuit along an extending direction of the plurality of data lines.

14. The display panel according to claim 1, wherein the display portion has a circular or polygonal shape.

15. The display panel according to claim 1, wherein the test switch and the selection switch each comprise a thin film transistor; and the test switch and the selection switch are of a same type.

16. A method for manufacturing a display panel, the method comprising:

providing a substrate;

forming a display portion comprising a plurality of data lines at a side of the substrate;

and forming a test circuit, a display control circuit and a selection circuit at the same side of the substrate, wherein the test circuit comprises a test switch, a test signal line and a test control line, the test switch having a control terminal electrically connected to the test control line, a first terminal electrically connected to the test signal line, and a second terminal electrically connected to a respective one of the plurality of data lines;

the display control circuit comprises a display switch, a display signal line and a display control line, the display switch having a control terminal electrically connected to the display control line, a first terminal electrically connected to the display signal line, and a second terminal electrically connected to a respective one of the plurality of data lines; and the selection circuit comprises a selection switch and a selection control line, the selection switch having a control terminal electrically connected to the selection control line, a first terminal electrically connected to a selection signal terminal, and a second terminal electrically connected to the display control line, wherein the selection signal terminal is configured to provide a signal for turning off the display switch when the test switch and the selection switch are turned on; and testing the display panel.

17. The manufacturing method according to claim 16, wherein testing the display panel comprises: providing a signal for turning on the test switch and the selection switch to the test control line, and at the same time, providing a signal for turning off the display switch to the selection signal terminal.

18. The manufacturing method according to claim 17, further comprising:

after testing is completed, providing a signal for turning off the test switch and the selection switch to the test control line.

19. The manufacturing method according to claim 17, further comprising:

removing the test circuit from the display portion after the testing is completed, wherein the display portion is located between the test circuit and the display control circuit along an extending direction of the plurality of data lines.

20. A display device comprising a display panel, wherein the display panel comprises:

a display portion comprising a plurality of data lines;

a test circuit comprising a test switch, a test signal line and a test control line, the test switch having a control terminal electrically connected to the test control line, a first terminal electrically connected to the test signal line, and a second terminal electrically connected to a respective one of the plurality of data lines;

a display control circuit comprising a display switch, a display signal line and a display control line, the display switch having a control terminal electrically connected to the display control line, a first terminal electrically connected to the display signal line, and a second terminal electrically connected to a respective one of the plurality of data lines; and a selection circuit comprising a selection switch and a selection control line, the selection switch having a control terminal electrically connected to the selection control line, a first terminal electrically connected to a selection signal terminal, and a second terminal electrically connected to the display control line, wherein the selection signal terminal is configured to provide a signal for turning off the display switch when the test switch and the selection switch are turned on.

* * * * *